US006122883A

United States Patent [19]

Braun

[11] Patent Number: 6,122,883

[45] Date of Patent: Sep. 26, 2000

[54] PLASTERING STRIP FOR WINDOW FRAMES, DOOR FRAMES OR THE LIKE AT THE TRANSITION TO THE PLASTER

[76] Inventor: August Braun, Quellenstrasse 24, CH-8200 Schaffhausen, Switzerland

[21] Appl. No.: 09/125,200

[22] PCT Filed: Feb. 13, 1997

[86] PCT No.: PCT/EP97/00675

§ 371 Date: Aug. 13, 1998

§ 102(e) Date: Aug. 13, 1998

[87] PCT Pub. No.: WO97/30245

PCT Pub. Date: Aug. 21, 1997

[30] Foreign Application Priority Data

Feb. 14, 1996 [DE] Germany ..... 196 05 467

[51] Int. Cl.[7] ..... E04F 13/06; E04F 19/04; E04F 19/02

[52] U.S. Cl. ..... 52/717.01; 52/211; 52/287.1; 52/98; 52/204.54; 52/254; 52/372; 52/573.1

[58] Field of Search ..... 52/211, 212, 204.53, 52/204.54, 254, 255, 366, 372, 393, 447, 448, 573.1, 98, 717.01, 100, 287.1, 454

[56] References Cited

U.S. PATENT DOCUMENTS

| | | | |
|---|---|---|---|
| 4,233,790 | 11/1980 | Meadows | 52/717.01 X |
| 4,484,411 | 11/1984 | Rystad | 52/212 X |
| 4,512,127 | 4/1985 | Attaway | 52/288.1 |
| 4,829,731 | 5/1989 | Schluter | 52/287.1 |
| 5,127,204 | 7/1992 | Braun | 52/454 X |
| 5,365,707 | 11/1994 | Jones et al. | 52/204.53 X |
| 5,596,852 | 1/1997 | Schiedegger | 52/211 X |
| 5,671,571 | 9/1997 | Braun | 52/211 |

FOREIGN PATENT DOCUMENTS

| | | |
|---|---|---|
| 3717317 | 12/1988 | Germany . |
| 4017250 | 12/1991 | Germany . |
| 4205927 | 8/1993 | Germany . |
| 4229080 | 3/1994 | Germany . |
| 4237820 | 5/1994 | Germany . |
| 89/04897 | 6/1989 | WIPO . |

*Primary Examiner*—Robert Canfield
*Attorney, Agent, or Firm*—Venable; George H. Spencer; Catherine M. Voorhees

[57] ABSTRACT

A plastering fillet for building components used at the transition to plaster is disclosed. The plastering fillet includes a base portion having a base wall, which can be secured to the building component. The base portion also has at least one extension perpendicular to the base wall and extending out therefrom. The plastering fillet also has a front portion having at least one web, which also projects perpendicular to the base wall of the base portion. The connection between the base portion and the front portion of the plastering fillet permits relative movement between the portions thereby preventing plaster cracking or breaking.

37 Claims, 2 Drawing Sheets

PLASTERING STRIP FOR WINDOW FRAMES, DOOR FRAMES OR THE LIKE AT THE TRANSITION TO THE PLASTER

BACKGROUND OF THE INVENTION

The invention relates to a plastering fillet for window casings, door casings or the like at the transition to the plaster, comprising the following features:

(a) the fillet has a base wall by means of which it can be secured to the window casing, door casing or the like;

(b) the fillet has at least one web which extends along the fillet and projects relative to the base wall.

A fillet of this type is known from the publication DE 87 15 604 U.

SUMMARY OF THE INVENTION

In the construction of buildings, window casings and door casings (i.e. the window or door frames fixedly connected to the building) are inserted into corresponding wall openings of the shell and secured therein. In a subsequent phase, the shell will be plastered on the outside and on the inside. In this respect, the connection of the plaster to the window or door casing constitutes a critical point in particular on the outside of the building, since the plaster abuts with its face side to the material of the window or door casing (as a rule wood, plastics or metal) and does not establish a perfect binding effect there. Due to the fact that the plaster shrinks somewhat during drying and as window casings and door casings are subject to vibrations, for example by forceful slamming of the windows or doors, there is a risk that a crack or gap is formed between the plaster and the window or door casing. Moisture may then penetrate at this location, which over the course of time causes damage to the window casing or door casing and/or damages the plaster, resulting for example in breaking out plaster pieces.

The known plastering fillet mentioned hereinbefore comprises an elastic adhesive tape of foam material, acting at the same time as a sealing band, and can be secured to the window casing, door casing or the like by means of the adhesive tape. The adhesive tape effects vibration-decoupling between the window casing or door casing and the fillet having the plaster adjoining the same. Due to such decoupling and due to the improved binding effect between fillet and plaster, a more perfect and longer non-failing plaster joint to the window casing, door casing or the like is created.

In case of the known plastering fillet, the extent of relative movement between the window casing, door casing or the like and the plaster, which the plaster joint established by means of the plastering fillet can sustain without taking damage, is dependent upon the elasticity of the adhesive tape of foam material. However, there are fields of application, e.g. very large windows, windows of relatively high houses, windows subjected to strong winds, in which the elasticity of the adhesive tape is not sufficient for obtaining a tolerance of relative movement in the desired extent.

It is the object of the invention to make available a plastering fillet of the type indicated at the outset, with which higher tolerances of relative movement can be realized due to the principle used in case of said fillet.

To meet this object, the fillet according to the invention is characterized in (c) that the fillet has a base portion of which the base wall forms part, and a front portion of which the at least one web forms part;

(d) and in that the front portion has a connection to the base portion which permits relative movement in the direction of a variation in distance to the base wall.

Due to the invention, the fillet no longer needs to rely on a compensation in relative movement by means of an elastic adhesive tape (although such an adhesive tape may be provided for attachment and for additional de-20 coupling), but rather, the tolerance of relative movement is present in the fillet itself, i.e. between the base portion and the front portion thereof. It is thus possible without any problem to realize a possibility of relative movement of greater extent than was previously possible.

There are numerous constructional possibilities for the design of the connection rendering possible said relative movement between the base portion and the front portion of the fillet. Particularly preferred is a design as a pluggable connection, with the relative movement being rendered possible by further mating and limited pulling apart, respectively. The connection preferably is a pluggable connection that is elongated in the longitudinal direction of the fillet.

The pluggable connection preferably is quite without play, in particular in the direction at right angles to the plaster surface.

As an additional possible alternative of the design of the connection, integral joining of the base portion and the front portion, e.g. via thin, flexible material portions in the form of film hinges, is pointed out. The connection according to the invention in terms of function only has to make sure that the relative movement mentioned is possible over the distances required.

The fillet preferably is delivered in a condition in which base portion and front portion are joined to each other, and is secured to the window casing, door casing or the like in this condition. For this reason, too, it is advantageous when the connection can be separated only using considerable forces or employing a tool. With respect to the pluggable connection, it is preferred that the pluggable connection, due to its shape, can be separated completely only when a release resistance is overcome.

A connection of particularly preferred construction is obtained when the base portion is provided with at least one extension projecting from the base wall, and the front portion is provided with at least one receiving space receiving said extension. The extension may be, in particular, an elongated wall-like extension, and analogously therewith, the receiving space may be, in particular, an elongated groove-like receiving space between two relatively closely adjacent walls. It is equally possible to reverse the structure, i.e. to provide the at least one extension on the front portion and the at least one receiving space on the base portion. In especially expedient manner, it is possible to integrate the at least one receiving space into the at least one web. A stable design of the connection, which is easily manufacture, is obtained when—as is preferred—there are provided two extensions projecting from the base wall, with the base portion being substantially U-shaped in cross-section.

The fillet according to the invention preferably is provided with two webs, with the front portion being substantially U-shaped in cross-section. The two webs may be designed as more or less perfect mirror images of each other. When two webs are provided, it is possible in particularly elegant manner to provide two receiving spaces integrated in the webs and to arrange them in paired manner with two extensions projecting from the base wall.

The at least one web is preferably undercut on its inside. This provides advantages for the binding effect to the plaster. Instead of or in addition thereto, it is also possible to employ a web undercut for locating a closure member which is provided for retaining the end portion of a reinforcing fabric section on the fillet. It is preferred in general that a reinforcing fabric section is attached to the front portion of the fillet.

On the side of the at least one web which faces away from the window casings, door casings or the like, the front portion preferably has a wall extension so that the web and the wall extension constitute a plaster receiving space which is angular in cross-section. This design, in particular, has the advantage that after application of the plaster, the fillet is visible to a lesser extent. As regards further details and preferred modifications of this development of the invention, reference is made to the publication DE 42 05 927 A, which in its contents is expressly incorporated in the present application.

Furthermore, according to a development of the invention it is preferred that the at least one web, on the side facing away from the window casings, door casings or the like when the fillet is mounted, is provided with a stepped back portion. This measure provides the advantage that a smoothing edge for a lower plaster layer is made available thereby, but in addition thereto also a smoothing edge for the final plaster layer. As regards further details and possible modifications of this development of the invention, reference is made to the publication DE 42 05 928 A which in its contents is expressly incorporated in the present application.

The fillet according to the invention preferably consists of plastics material, with polyethylene and polyvinyl chloride being feasible in particular.

BRIEF DESCRIPTION OF THE DRAWINGS

The invention and developments of the invention will be described in more detail hereinafter by way of embodiments shown in the drawings in which.

DETAILED DESCRIPTION OF THE PREFERRED EMBODIMENT

Figure 1:
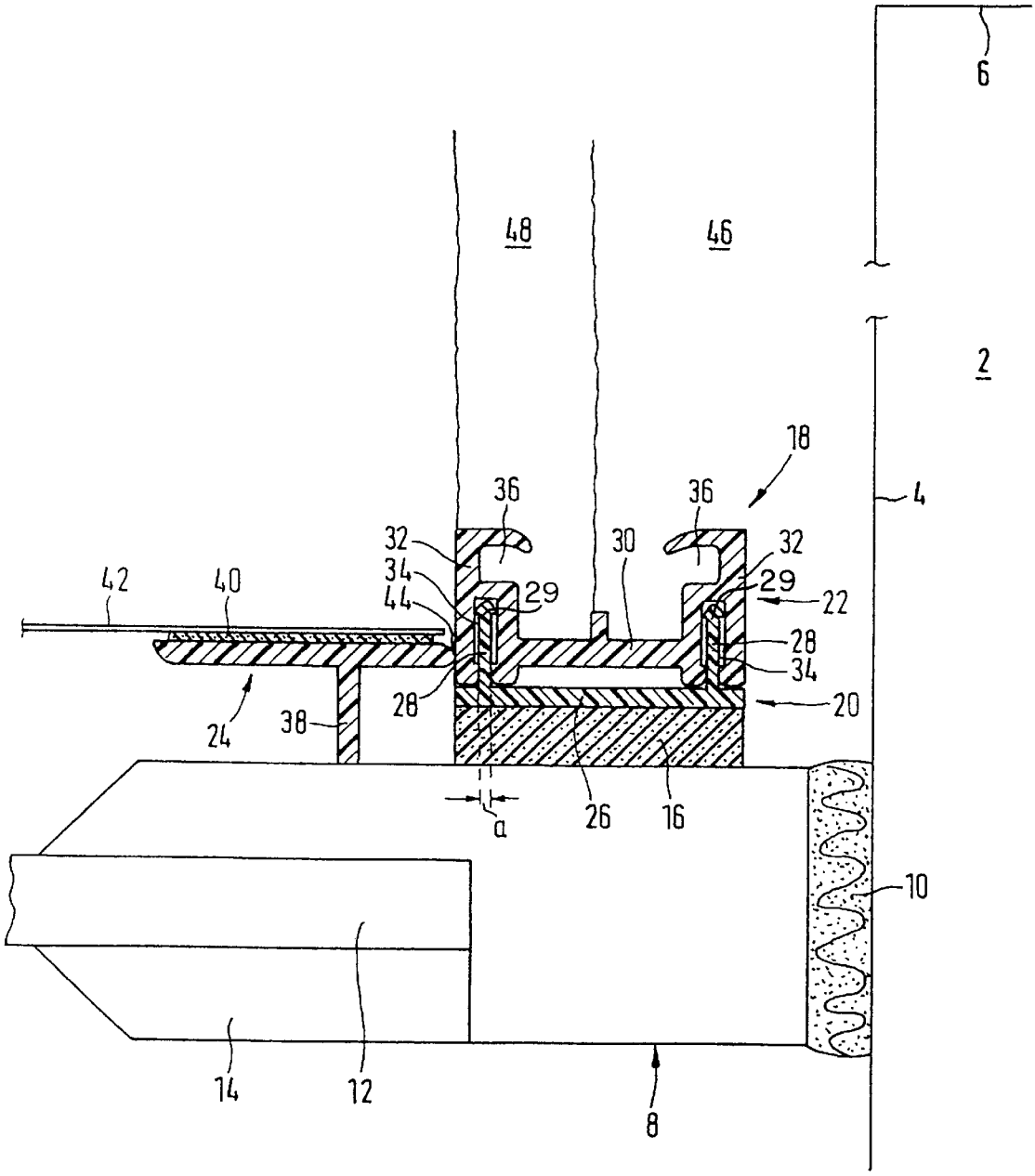
FIG. 1 shows a cross-sectional view of a fillet adhered to a window casing or door casing, after application of the wall plaster.

FIG. 1 shows a horizontal cross-section of part of a house wall 2, which may consist for example of masoned stones or of concrete. The outside of the house is located at the top of the drawing page of FIG. 1, and the house inside is located at the bottom of the drawing page of FIG. 1. The confining line extending in vertical direction of FIG. 1 constitutes the casings 4, and the upper confining line of wall 2, which extends in horizontal direction in FIG. 1, represents the outer surface 6 of the unplastered wall 2. Quite a distance to the left from the drawing edge of FIG. 1, an identical wall section in mirror-image would have to be conceived of, so that the two casings surfaces confine a wall opening on both sides.

Secured in the wall opening is a window casing 8, with the gap between the outside of window casing 8 and the casings 4 being filled by cured polyurethane foam 10. Secured in window casing 8 is a glass pane 12, preferably a double glass pane, by means of a subsequently attached block fillet 14. Thus, a fixed window pane 12 is involved here. In case of a window wing that can be opened, the pane 12 is not mounted directly in the window casing 8, but in an openable window frame attached to window casing 8 by hinges.

On the outside of window casing 8, a plastering fillet 18, in the following briefly referred to as "fillet 18", is adhered thereto by means of an adhesive tape 16. Adhesive tape 16 consists of foamed plastics material of high strength, which in fact is resiliently elastic, but nevertheless has a relatively high resistance to compression. Adhesive tape 16 at the same time serves as a sealing tape.

Apart from adhesive tape 16, fillet 18 in essence comprises a base portion 20, a front portion 22 and a protective flap 24. Base portion 20 is of substantially U-shaped cross-section, which is constituted by a base wall 26 that is planar in the depicted embodiment and to the rear of which the adhesive tape 16 is adhered, and of two extensions 28 projecting at right angles from the front side of base wall 26. Extensions 28 extend in the longitudinal direction of fillet 18 in the manner of walls. They are in principle of even thickness a, but are each slightly broadened at the free end so that the wall thickness thereof increases in step-like manner.

The cross-section of front portion 22 of fillet 18—roughly speaking—can also be referred to as U-shaped.

It is constituted by a bottom wall 30 and two webs 32 projecting therefrom at right angles in forward direction—very roughly speaking. Each web 32 in its rear part closer to bottom wall 30 is of double-walled construction so that one receiving space 34 each is provided there in the form of a deep groove. Each receiving space 34 is closed at the front and open at the rear, but with the groove width being slightly reduced at each opening by a shoulder provided on both sides. The dimensions are such that the upper, broadened end 29 of the particular extension 28 is received in the associated receiving space 34 virtually without play, whereas the particular extension 28 has its non-increased wall thickness disposed substantially without play in the receiving space opening of reduced width. Base portion 20 and front portion 22 have been produced as separate parts by plastics extrusion and have been united by introducing the two extensions 28 into the two receiving spaces 34, overcoming a resistance during passage through the receiving space ends of reduced width.

In the united state shown in the drawings, the base portion 20, e.g. when window casing 8 is subjected to wind pressure and thus moves downward in FIG. 1, is capable of carrying out a movement to the rear (i.e. in downward direction in FIG. 1) in relation to the front portion 22 which along with the plaster remains stationary. The pluggable connection of the type of a telescoped pair between base portion 20 and front portion 22 permits such movement without a problem.

In the region adjoining the double-walled part in forward direction, each web 32 is single-walled and narrower, and in the front end portion each web 32 is curved towards the inside so that an undercut 36 is formed there. Due to these undercuts 36, the plaster introduced into the U-shaped interior space of front portion 22 is given an especially good retention effect.

The two webs 32 as a whole, just as the entire front portion 22 described so far, as well as the entire base portion 20 are formed as mirror images with respect to a common longitudinal central plane.

Adjoining the left-hand web 32 in FIG. 1 on the outside is said strip-shaped protective flap 24. The front side of protective flap 24 is of planar design and there carries an adhesive layer 40. Adhered to adhesive layer 40 is a protective film 42 which extends from fillet 18 to the rear in FIG. 1. When imagining that window casing 18 on all of its four sides is provided with an adhered plastering fillet, it becomes clear that protective film 42 covers the entire opening between the four plastering fillets 18 and in this manner protects window casing 18 from soiling when the plaster is applied.

On the rear side, protective flap 24 has a spacer web 38 projecting substantially at right angles to the rear. Spacer web 38 is of such a height that protective flap 24 via this spacer web 38 is supported on its rear side on window casing 8 in such a manner that the front side of protective flap 24 is substantially parallel to the front side of window casing 8.

FIG. 1 shows furthermore that a first or lower coating 46 of plaster is applied to intrados 4 and a second or upper coating 48 of plaster is applied on top of first coating 46. In smoothing the upper coating 48, it is possible to use the outside of the left-hand web 32 in FIG. 1 as smoothing edge.

After the entire plastering work has been finished, protective film 42 is removed, and protective flap 24 is broken off at a break-off material bridge 44 of reduced material thickness.

Figure 2:
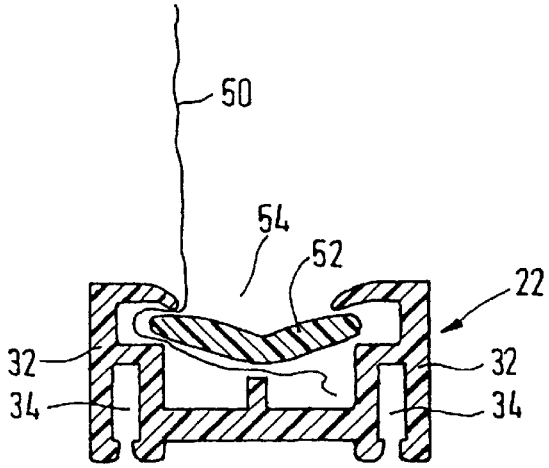
FIG. 2 shows a cross-sectional view of part of a fillet according to another embodiment, indicating a closure member and a reinforcing material section.
Figure 3:
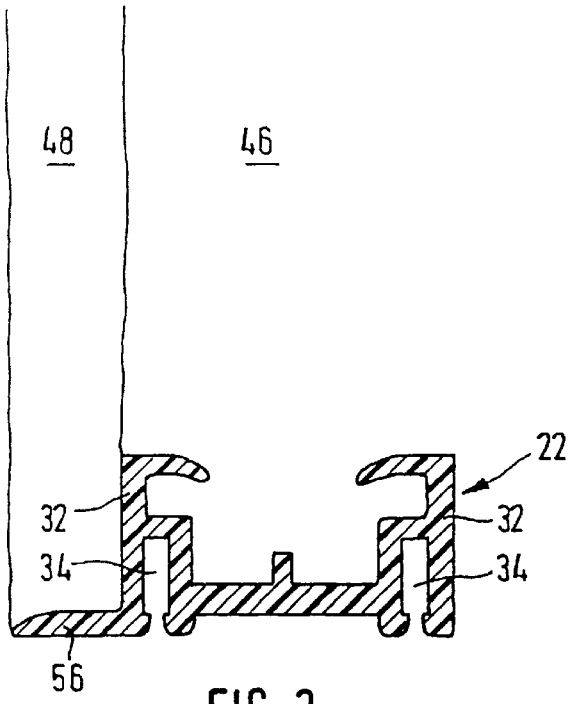
FIG. 3 shows a cross-sectional view of a fillet according to a further embodiment, indicating a wall extension and a plaster receiving space.
Figure 4:
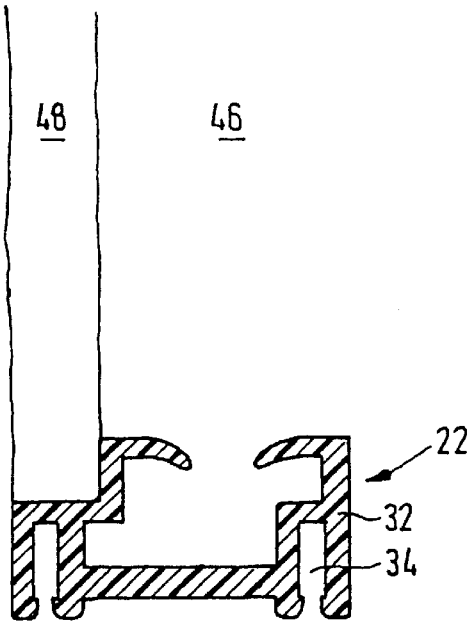
FIG. 4 shows a cross-sectional view of a fillet according to a further embodiment, indicating a stepped back portion of the web the outside.

For reasons of simplification of the drawings, FIGS. 2, 3, 4 only depict the front portion 22 of a fillet 18, omitting also a protective flap 24.

FIG. 2 illustrates an embodiment in which a reinforcing fabric section 50 is attached to fillet 18 by means of a closure member 52. Closure member 52, which may consist of plastics material, has been inserted at a later time through the "opening" 54 of fillet 18 in the form of a slot between the free ends of the two webs 32 and is locked there in a snap-fit. The end portion of a reinforcing fabric section 50 in doing so has been clamped between closure member 52 and at least one of the two webs 32. The reinforcing fabric usually consists of a net-like plastics sheet material. Reinforcing fabric 50 serves for improved adhesion and for keeping the plaster free from cracks when the plaster is applied to polystyrene boards that may be attached to wall 2 as full thermal insulation.

FIG. 3 illustrates the provision of a wall extension on the in FIG. 3 left-hand side of left web 32. Due to wall extension 56 an angular plaster receiving space 58 is formed. After application of the upper plaster coating 48, only the small free end of wall extension 56 of fillet 18 is still visible.

FIG. 4 illustrates a fillet design in which the left-hand web 32 in FIG. 4 has a stepped back portion or Z-shaped double crank towards the inside. In this case, the front portion of web 32 can be used as smoothing edge when first plaster coating 46 is applied, and the rear portion of left-hand web 32 can be used as smoothing edge when second plaster coating 48 is applied. It is to be understood that, if desired, the embodiments according to FIG. 3 and FIG. 4 may also be provided with a closure member 52 or a different means of attachment for the reinforcing fabric section.

It is to be emphasized that the cross-section of fillet 18, i.e. of front portion 22, base portion 20 and protective flap 24, remains constant over the entire length thereof, so that fillet 18 can easily be produced by extrusion. Fillet 18 preferably consists of plastics material, with metal being a possible alternative.

Typical dimensions of the fillet are:

8 to 40 mm width of base portion 20 and front portion 22;

5 to 40 mm web height;

0.5 to 3 mm material thickness;

8 to 20 mm width of protective flap;

2.5 to 6 mm thickness of adhesive tape.

Finally, it is pointed out that the fillet according to the invention can be utilized not only at the transition from a window casing or door casing to wall plaster, but can be used generally at all locations where plaster is adjoining a component of wood, plastics or metal. Another example in this respect are beams emanating from a wall.

Instead of an adhesive tape 16, the fillet could also be attached to window casing 8 e.g. by means of a strip of self-adhesive permanent-plastic sealing compound, preferably butyl caoutchouc or a hot-melt adhesive.

I claim:

1. A plastering fillet for building components, including window casings and door casings, at the transition to plaster, comprising:

(a) the fillet has a base wall by means of which it can be secured to the building component;

(b) the fillet has at least one web which extends along the fillet and projects relative to the base wall;

(c) the fillet has a base portion of which the base wall forms a part, and a front portion of which the at least one web forms a part;

wherein, (d) the front portion has a guiding connection to the base portion which permits relative movement;

(e) the front portion, carried by the base portion, is adapted to be secured to the building component by means of said base portion; and (f) the guiding connection compress on the base portion two extensions projecting from the base wall, and in the front portion at least two receiving spaces each receiving one of said extensions, and the base portion being substantially U-shaped in cross-section.

2. The fillet according to claim 1, wherein two webs are provided and the front portion is substantially U-shaped in cross-section.

3. The fillet according to claim 1, wherein the at least one web has an inside and wherein the at least one web is undercut on the inside.

4. The fillet according to claim 1, wherein the base wall is provided with an adhesive tape for attaching the fillet to the building components.

5. The plastering fillet according to claim 1, wherein the front portion has a reinforcing fabric section secured thereto.

6. The plastering fillet according to claim 5, wherein two webs are provided and an end portion of the reinforcing fabric section is held in a space between the two webs by means of a closure member.

7. The plastering fillet according to claim 1, wherein a strip-shaped protective flap is provided which is contiguous with the base portion via a break-off material of small thickness.

8. The plastering fillet according to claim 7, wherein the at least one web has a wall extension, so that the web and the wall extension constitute a plaster receiving space of angular cross-section.

9. The plastering fillet according to claim 8, wherein the at least one web has a stepped back portion on a side of the web.

10. The plastering fillet according to claim 1, wherein the connection between the base portion and the front portion is a pluggable connection that is elongated in the longitudinal direction of the fillet.

11. The plastering fillet according to claim 10, wherein the pluggable connection can be separated completely only by overcoming a release resistance due to the shape thereof.

12. The plastering fillet according to claim 1, wherein at least one receiving space is integrated into the at least one web.

13. A plastering fillet for building components, including window casings and door casings at the transition to plaster, comprising:

(a) the fillet has a base wall by means of which it can be secured to the building component;

(b) the fillet has at least one web which extends along the fillet and projects relative to the base wall;

(c) the fillet has a base portion of which the base wall forms a part, and a front portion of which the at least one web forms a part;

wherein, (d) the front portion has a guiding connection to the base portion which permits relative movement;

(e) the front portion, carried by the base portion, is adapted to be secured to the building component by means of said base portion; and (f) the front portion has a reinforcing fabric section secured thereto.

14. The plastering fillet according to claim 10, wherein two webs are provided and in that an end portion of the reinforcing fabric section is held in a space between the two webs by means of a closure member.

15. The plastering fillet according to claim 10, wherein two webs are provided and wherein the front portion is substantially U-shaped.

16. The plastering fillet according to claim 10, wherein a strip-shaped protective flap is provided which is contiguous with one of the base portion and the front portion via a break-off material of small thickness.

17. The plastering fillet according to claim 16, wherein the at least one web, has a wall extension, so that the web and the wall extension constitute a plaster receiving space of angular cross-section.

18. The plastering fillet according to claim 17, wherein the at least one web has a stepped back portion on a side of the web.

19. The plastering fillet according to claim 13, wherein the connection between the base portion and the front portion is a pluggable connection that is elongated in the longitudinal direction of the fillet.

20. The plastering fillet according to claim 19, wherein the pluggable connection can be separated completely only by overcoming a release resistance due to the shape thereof.

21. The plastering fillet according to claim 13, wherein the guilding connection compress on the base portion at least one extension projecting from the base wall and on the front portion at least one receiving space receiving said extension.

22. The plastering fillet according to claim 21, wherein the at least one receiving space is integrated into the at least one web.

23. The plastering fillet according to claim 13, wherein the at least one web has an inside and wherein the at least one web is undercut on the inside.

24. The plastering fillet according to claim 13, wherein the base wall is provided with an adhesive tape for attaching the fillet to the building components.

25. A plastering fillet for building components, including window casings and door casings at the transition to plaster, comprising:

(a) the fillet has a base wall by means of which it can be secured to the building component;

(b) the fillet has at least one web which extends along the fillet and projects relative to the base wall;

(c) the fillet has a base portion of which the base wall forms a part, and a front portion of which the at least one web forms a part;

wherein, (d) the front portion has a guiding connection to the base portion which permits relative movement;

(e) the front portion, carried by the base portion, is adapted to be secured to the building component by means of said base portion; and (f) a strip-shaped protective flap is provided which is contiguous with one of the base portion and the front portion via a break-off material bridge of small thickness.

26. The plastering fillet according to claim 25, wherein the at least one web has a wall extension, so that the web and the wall extension constitute a plaster receiving space of angular cross-section.

27. The plastering fillet of claim 26, wherein the at least one web has a stepped back portion on a side of the web.

28. The plastering fillet according to claim 25, wherein two webs are provided and in that the front portion is substantially U-shaped in cross-section.

29. The plastering fillet according to claim 25, wherein the front portion has a reinforcing fabric section secured thereto.

30. The plastering fillet according to claim 29, wherein two webs are provided and in that an end portion of the reinforcing fabric is held in a space between the two webs by means of a closure member.

31. The plastering fillet according to claim 25, wherein the connection between the base portion and the front portion is a pluggable connection that is elongated in the longitudinal direction of the fillet.

32. The plastering fillet according to claim 31, wherein the pluggable connection can be separated completely only by overcoming a release resistance due to the shape thereof.

33. The plastering fillet according to claim 25, wherein the guilding connection compress on the base portion at least one extension projecting from the base wall and on the front portion at least one receiving space receiving said extension.

34. The plastering fillet according to claim 33, wherein the at least one receiving space is integrated into the at least one web.

35. The plastering fillet according to claim 25, wherein the at least one web has an inside and wherein the at least one web is undercut on the inside.

36. The plastering fillet according to claim 25, wherein the base wall is provided with an adhesive tape for attaching the fillet to the building components.

37. A plastering fillet for building components including window casings and door casings, comprising:

a base portion having a base wall, said base wall having a back side and a front side, said back side adapted to be secured to a wall, said front side having two extensions perpendicular thereto; and a front portion, having a bottom wall and two webs perpendicular to said bottom wall, each said web having a double walled lower portion, each said double wall forming a receiving space therein, each said receiving space having a front and a rear, said front being closed and said rear being open and adapted to receive the extensions of the base portion thereby forming a connection between said front portion and said base portion, which connection permits relative movement in the direction of the extensions.

* * * * *